US006736618B2

(12) United States Patent
Wu

(10) Patent No.: US 6,736,618 B2
(45) Date of Patent: May 18, 2004

(54) PUMP FOR EASY ATTACHMENT TO BICYCLE

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 23 days.

(21) Appl. No.: 10/189,440

(22) Filed: Jul. 8, 2002

(65) Prior Publication Data

US 2004/0005233 A1 Jan. 8, 2004

(51) Int. Cl.[7] ..... F04B 11/00; F04B 39/10; F04B 53/12

(52) U.S. Cl. ..... 417/554; 92/58.1

(58) Field of Search ..... 417/523, 525, 417/527, 528, 572, 554, 544, 547, 552; 92/58.1

(56) References Cited

U.S. PATENT DOCUMENTS 4,120,614 A * 10/1978 Bouder ..... 417/63
4,569,275 A * 2/1986 Brunet ..... 92/58.1
5,782,621 A * 7/1998 Harris ..... 417/470
6,506,026 B2 * 1/2003 Wu ..... 417/234
6,615,704 B2 * 9/2003 Chuang ..... 92/58.1

* cited by examiner

*Primary Examiner*—Justine R. Yu
*Assistant Examiner*—William H. Rodriguez
(74) *Attorney, Agent, or Firm*—Charles E. Baxley

(57) ABSTRACT

A pump includes a cylinder, a tube, a hollow piston, a nozzle, a hollow handle and an elastic element. The tube is partially and movably inserted in the cylinder. The hollow piston is in fluid communication with the tube and movably received in the cylinder for pumping. The nozzle is in fluid communication with the tube, and includes an end face in compliance with a first external structure. The hollow handle is mounted on the cylinder between a first mode preventing their relative movement and a second mode allowing their relative movement. The hollow handle includes an open end through which the tube is inserted and a closed end with an internal face and an external face in compliance with a second external structure. The elastic element is compressed between an end of the cylinder and the closed end of the hollow handle.

11 Claims, 7 Drawing Sheets

3-3

5-5

PUMP FOR EASY ATTACHMENT TO BICYCLE

BACKGROUND OF INVENTION

1. Field of Invention

The present invention is related to a pump for easy attachment to a bicycle.

2. Related Prior Art

Cycling is a very popular activity for traveling and/or exercising. A lot of riders like to carry pumps with them for use in case of emergency. Pumps are classified into large, medium and small sizes. Pumps of the large size are capable of pumping in a time-economic manner; however, they are often too bulky and heavy for bicycle riders to carry. Pumps of the small size can be easily carried by bicycle riders; however, can are not capable of pumping in a time-economic manner. It has been found that pumps of the medium size provide a balance between time economics and easiness of carrying for bicycle riders.

SUMMARY OF INVENTION

It is the primary objective of the present invention to provide a pump for easy attachment to a bicycle.

According to the present invention, a pump includes a cylinder, a tube, a hollow piston, a nozzle, a hollow handle and an elastic element. The tube is partially and movably inserted in the cylinder. The hollow piston is in fluid communication with the tube and movably received in the cylinder for pumping. The nozzle is in fluid communication with the tube, and includes an end face in compliance with a first external structure. The hollow handle is mounted on the cylinder between a first mode preventing their relative movement and a second mode allowing their relative movement. The hollow handle includes an open end through which the tube is inserted and a closed end with an internal face and an external face in compliance with a second external structure. The elastic element is compressed between an end of the cylinder and the closed end of the hollow handle.

At least one block is formed on an external face of the cylinder or an internal face of the hollow handle. At least one L-shaped groove is defined in the internal face of the hollow handle or the external face of the cylinder. The at least one L-shaped groove includes a transverse section and a longitudinal section. In the first mode, the at least one block is received in the transverse section of the at least one L-shaped groove. In the second mode, the at least one block is received in the longitudinal section of the at least one L-shaped groove The pump includes a collar mounted on the cylinder and connected with the hollow handle for abutment against the at least one block, thus retaining the hollow handle on the cylinder.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
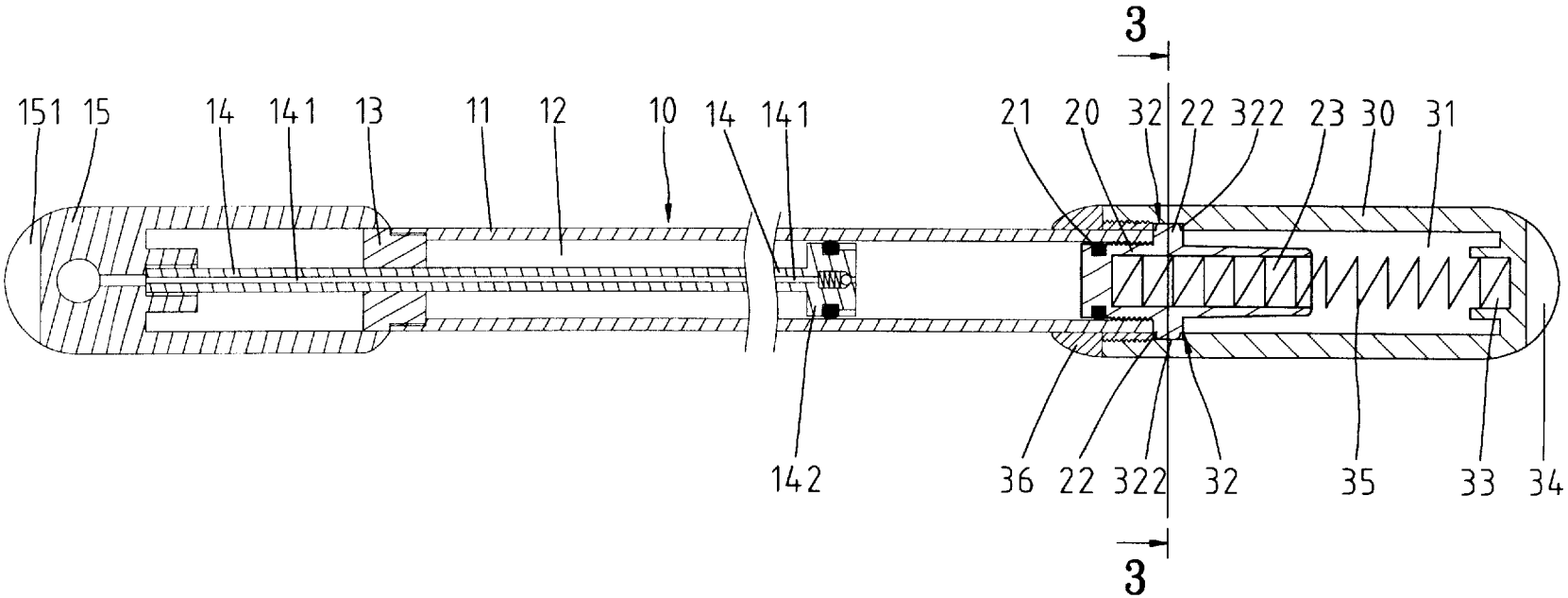
FIG. 1 is a cross-sectional view of a pump according to the present invention.
Figure 2:
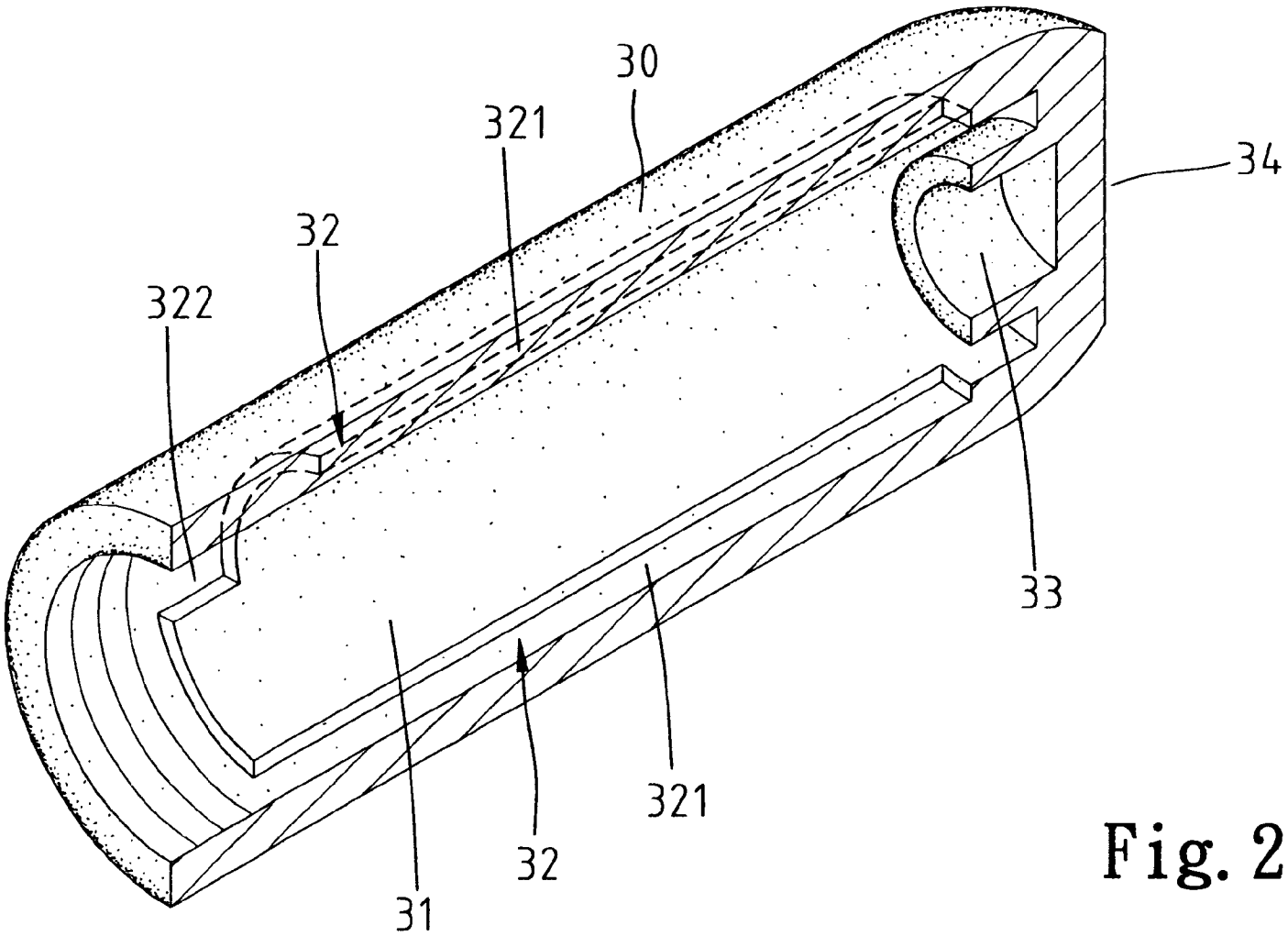
FIG. 2 is a perspective cross-sectional view of a handle used in the pump.
Figure 3:
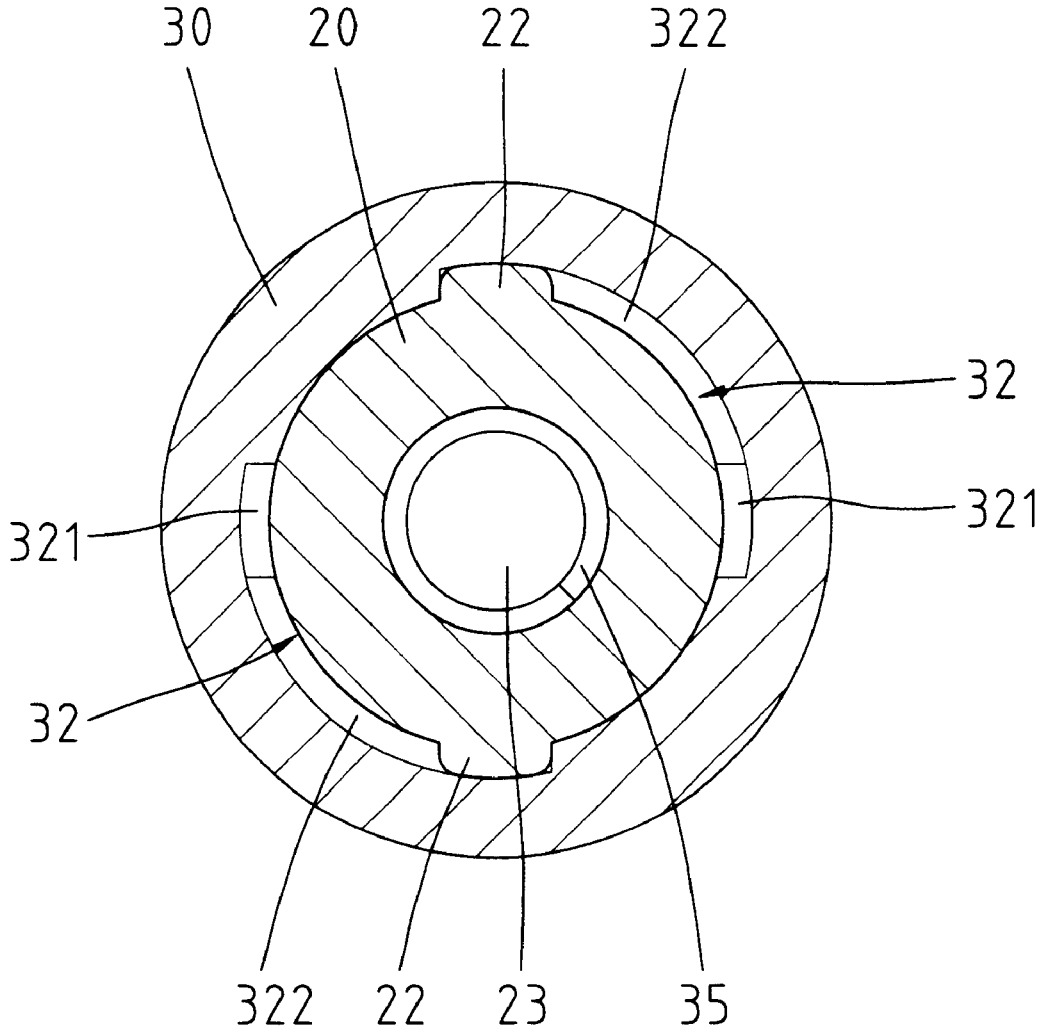
FIG. 3 is a cross-sectional view taken along a line 3—3 in FIG. 1.

Referring to FIGS. 1~3, according to the preferred embodiment of the present invention, a pump 10 includes a cylinder 11 through which a channel 12 extends. A first thread is formed on an internal face of the cylinder 11 at a first end, and a second thread is formed on the internal face of the cylinder 11 at a second end.

An annular element 13 is formed with a thread on an external face.

A tube 14 is formed with a thread (not numbered) at a first end and a piston 142 at a second end. A channel 141 extends through the tube 14 and the piston 142. A check valve (not numbered) is received in the piston 142 in a conventional manner and therefore will not be described in detail. An annular seal (not numbered) is mounted on the piston 142 in a conventional manner and therefore will not be described in detail.

The piston 142 is received in the cylinder 11, and the tube 14 is partially inserted in the cylinder 11. The tube 14 is inserted through the annular element 13. The thread formed on the annular element 13 is brought into engagement with the first thread formed on the cylinder 11.

A nozzle 15 on which a nozzle (not shown) is formed with a recess 151 at a first end and a thread formed on an internal face. The first end of the tube 14 is inserted in the nozzle 15. The thread formed on the tube 14 is engaged with the thread formed on the nozzle 15.

A collar 36 is formed with a thread on an external face. The collar 36 is mounted on the cylinder 11 near the second end of the cylinder 11.

A sealing and anchoring element 20 is formed with a thread and two blocks 22. The blocks 22 are opposite to each other along a diameter of the sealing and anchoring element 20. An annular seal 21 is mounted on the sealing and anchoring element 20. The thread formed on the sealing and anchoring element 20 is engaged with the second thread formed on the cylinder 11. The blocks 22 are abut against the second end of the cylinder 11.

A hollow handle 30 is open at a first end and closed at a second end. Two L-shaped grooves 32 are defined in an internal face of the hollow handle 30. Each of the L-shaped grooves 32 includes a longitudinal section 321 extending in a longitudinal direction of the hollow handle 30 and a transverse section 322 extending in a peripheral direction of the hollow handle 30. A thread is formed on the internal face of the hollow handle 30 at the first end. A recess 34 is defined in an external face of the hollow handle 30 at the second end.

A spring 35 is received in the hollow handle 30 so that it can be compressed between the sealing and anchoring element 20 and the hollow handle 30. The thread formed on the hollow handle 30 is engaged with the thread formed on the collar 36 so as to retain the hollow handle 30 on the cylinder 11. The hollow handle 30 can be rotated on the cylinder 11. Thus, each of the blocks 22 can be moved between the transverse section 322 and the longitudinal section 321 of one of the L-shaped grooves 32.

In the preferred embodiment, the sealing and anchoring element 20 defines a recess 23 in order to receive a first end of the spring 35, and a recess 33 is defined in the internal face of the hollow handle 30 at the second end in order to receive a second end of the spring 35. Thus, the spring 35 can be retained in position.

To pump, the hollow handle 30 is rotated on the cylinder 11 to a first position shown in FIGS. 1 and 3. In the first position, each of the blocks 22 is located in the transverse section 322 of one of the L-shaped grooves 32, thus avoiding longitudinal sliding of the hollow handle 30 relative to the sealing and anchoring element 20. The hollow handle 30 can be reciprocated relative to the nozzle 15. Therefore, the cylinder 11 can be reciprocated relative to the piston 142 for pumping. Since compression of the spring 35 is avoided, no energy is wasted on compression of the spring 35 during pumping.

Figure 4:
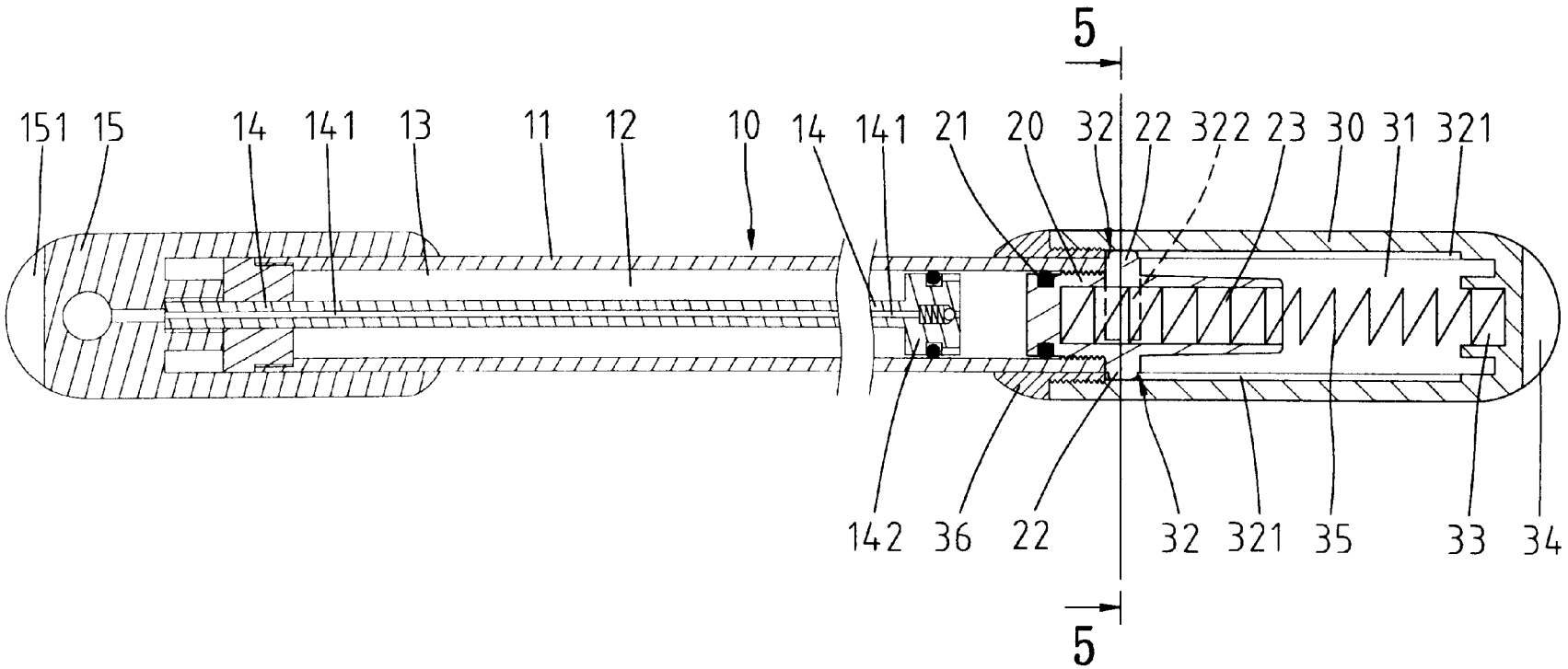
FIG. 4 is similar to FIG. 2 but showing the handle in another second position.
Figure 5:
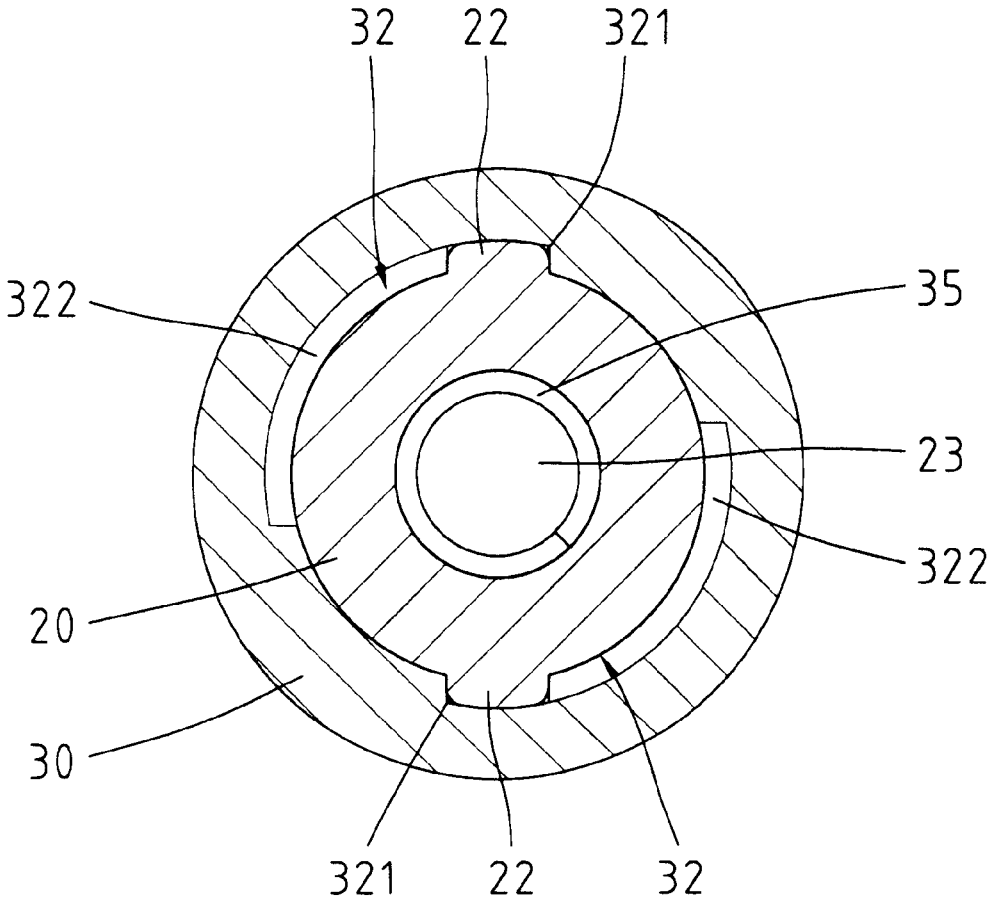
FIG. 5 is a cross-sectional view taken along a line 5—5 in FIG. 4.
Figure 6:
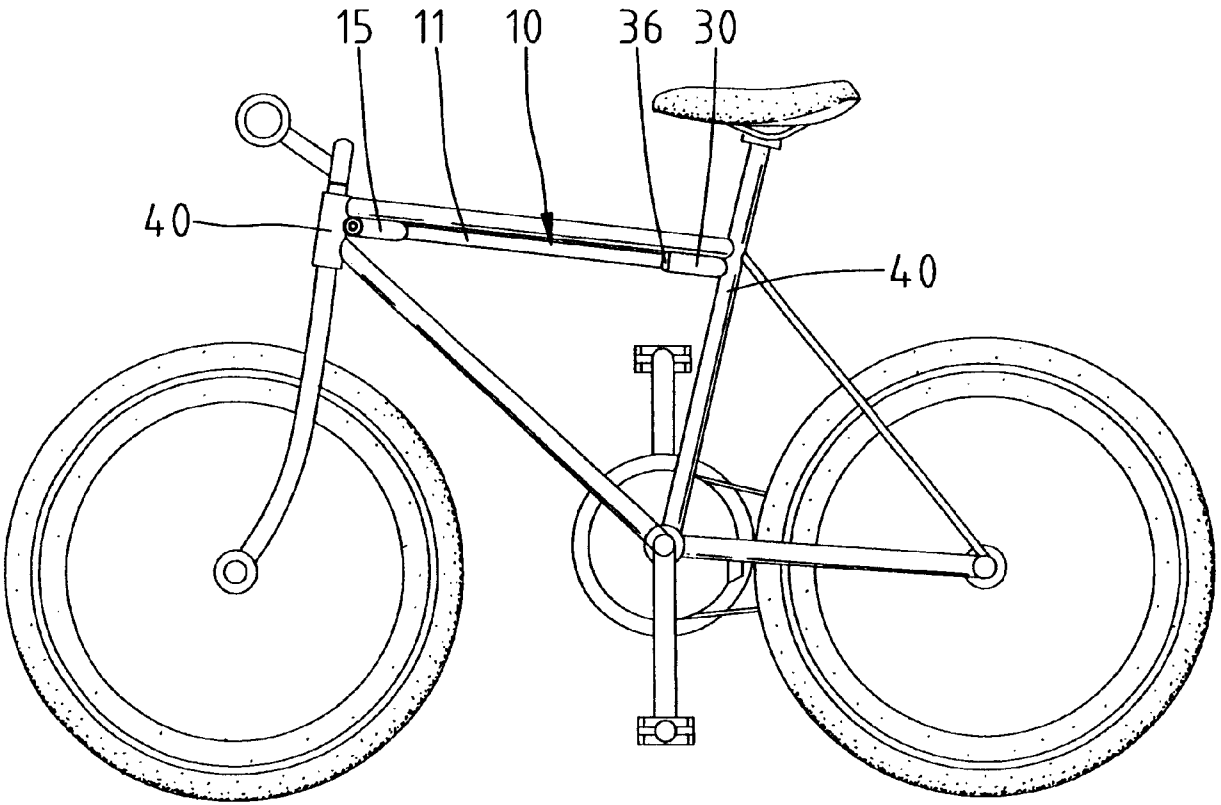
FIG. 6 is a side view of a bicycle on which the pump is mounted.
Figure 7:
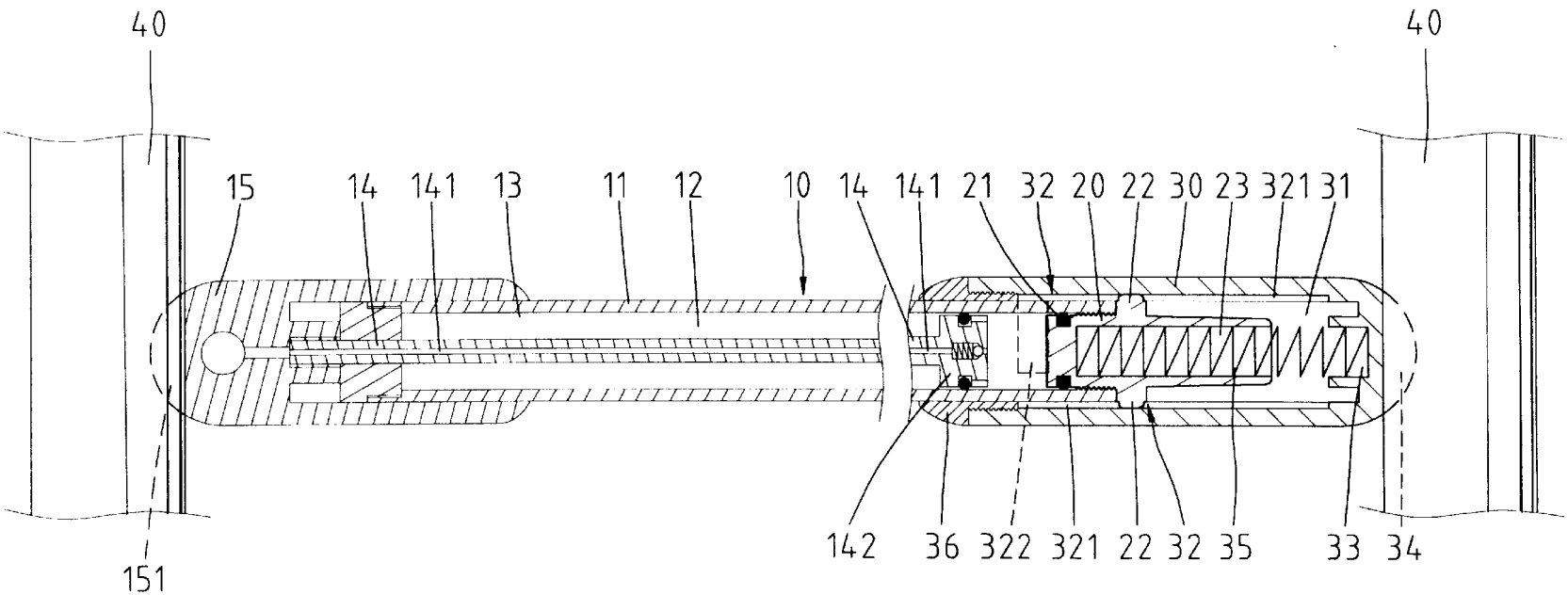
FIG. 7 is a cross-sectional view of the pump when it is retained between two tubes of the bicycle.

To attach the pump 10 to a bicycle as shown in FIGS. 6 and 7, the hollow handle 30 is rotated on the cylinder 11 to a second position shown in FIGS. 4 and 5. In the second position, each of the blocks 22 is aligned with the transverse section 322 of one of the L-shaped grooves 32, thus allowing longitudinal sliding of the hollow handle 30 relative to the sealing and anchoring element 20. The nozzle 15 and the hollow handle 30 can be moved toward each other so as to reduce a length of the pump 10 so that the pump 10 can be located between two tubes 40 of the bicycle. The spring 35 is compressed. The tubes 40 are aligned with the recesses 151 and 34, respectively. Finally, the nozzle 15 and the hollow handle 30 can be released so that the spring 35 can cause the nozzle 15 to firmly abut one of the tubes 40 and the hollow handle 30 to firmly abut the remaining one of the tubes 40. Thus, the pump 10 is retained on the bicycle.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A pump (10) comprising:

a cylinder (11);

a tube (14) partially and movably inserted in the cylinder (11);

a hollow piston (142) being in fluid communication with the tube (14) and movably received in the cylinder (10) for pumping;

a nozzle (15) being in fluid communication with the tube (14) and including an end face (151) in compliance with a first external structure (40);

a hollow handle (30) being mounted on the cylinder (11) between a first mode preventing their relative movement and a second mode allowing their relative movement, the hollow handle (30) including an open end through which the tube (14) is inserted and a closed end with an external face (34) in compliance with a second external structure (40); and an elastic element (35) compressed between an end of the cylinder (11) and the closed end of the hollow handle (30), further comprising at least one block (22) formed on one of an external face of the cylinder (11) and an internal face of the hollow handle (30) and at least one L-shaped groove (32) defined in the remaining one of the external face of the cylinder (11) and the internal face of the hollow handle (30), the at least one L-shaped groove (32) including a transverse section (322) for receiving the at least one block (22) in the first mode and a longitudinal section (321) for receiving the at least one block (22) in the second mode.

2. The pump according to claim 1 wherein the at least one block (22) is formed on the external face of the cylinder (11), and the at least one L-shaped groove (32) is defined in the internal face of the hollow handle (30).

3. The pump according to claim 2 including a collar (36) mounted on the cylinder (11) and connected with the hollow handle (30) for abutment against the at least one block (22), thus retaining the hollow handle (3) on the cylinder (11).

4. The pump according to claim 1 including a sealing element (20) attached to an end of the cylinder (11).

5. The pump according to claim 4 including at least one block (22) formed on one of the cylinder (11) and the sealing element (20) and at least one L-shaped groove (32) defined in an internal face of the hollow handle (30), the at least one L-shaped groove (32) including a transverse section (322) for receiving the at least one block (22) in the first mode and a longitudinal section (321) for receiving the at least one block (22) in the second mode.

6. The pump according to claim 5 wherein the at least one block (22) is formed on the cylinder (11).

7. The pump according to claim 5 including a collar (36) mounted on the cylinder (11) and connected with the hollow handle (30) for abutment against the at least one block (22), thus retaining the hollow handle (30) on the cylinder (11).

8. The pump according to claim 4 wherein the spring (35) is compressed between the sealing element (20) and the closed end of the hollowing handle (30).

9. The pump according to claim 4 wherein the sealing element (20) defines a recess (23) for receiving the elastic element (35).

10. The pump according to claim 4 including an annular seal (21) mounted on the sealing element (20).

11. The pump according to claim 1 wherein the closed end of the hollow handle (30) includes a recess (33) defined in an internal face thereof for receiving the elastic element (35).

* * * * *